US006478914B1

(12) United States Patent
Bartlett et al.

(10) Patent No.: US 6,478,914 B1
(45) Date of Patent: Nov. 12, 2002

(54) METHOD FOR ATTACHING WEB-BASED POLISHING MATERIALS TOGETHER ON A POLISHING TOOL

(75) Inventors: Aaron T. Bartlett, Boise; Gary O. Henderson, Meridian, both of ID (US)

(73) Assignee: Micron Technology, Inc., Boise, ID (US)

( * ) Notice: Subject to any disclaimer, the term of this patent is extended or adjusted under 35 U.S.C. 154(b) by 3 days.

(21) Appl. No.: 09/590,446

(22) Filed: Jun. 9, 2000

(51) Int. Cl.[7] ..... B31F 5/00
(52) U.S. Cl. ..... 156/159; 156/157; 156/502
(58) Field of Search ..... 156/157, 159, 156/502

(56) References Cited

U.S. PATENT DOCUMENTS 4,921,566 A * 5/1990 Stork ..... 156/354
5,514,237 A * 5/1996 Emenaker et al. ..... 156/157
5,562,796 A * 10/1996 Ertel ..... 100/258 A
5,618,377 A * 4/1997 Kaneko et al. ..... 156/159
5,653,848 A * 8/1997 Yamamoto et al. ..... 156/159
5,669,998 A * 9/1997 Ward et al. ..... 156/157
5,709,761 A * 1/1998 Tajima et al. ..... 156/159
6,056,841 A * 5/2000 Knokey ..... 156/159
6,328,088 B1 * 12/2001 Draghetti ..... 156/159

* cited by examiner

*Primary Examiner*—Mark A. Osele
(74) *Attorney, Agent, or Firm*—Fletcher, Yoder & Van Someren

(57) ABSTRACT

A method and apparatus for thermally attaching web-based polishing pads in a chemical-mechanical planarization (CMP) system. Specifically, one end of a first web-based polishing pad and an end of a second web-based polishing pad are inserted in a thermal sealing unit. The ends of the polishing pads are brought into contact with each other and secured in place within the thermal sealing unit. A heating element within thermal sealing unit is activated, thereby fusing the polishing pads.

26 Claims, 4 Drawing Sheets

METHOD FOR ATTACHING WEB-BASED POLISHING MATERIALS TOGETHER ON A POLISHING TOOL

BACKGROUND OF THE INVENTION

1. Field of the Invention

The present invention relates to the fabrication of integrated circuits and, more particularly, to the field of polishing and planarizing semiconductor wafers.

2. Description of the Related Art

This section is intended to introduce the reader to various aspects of art which may be related to various aspects of the present invention which are described and/or claimed below. This discussion is believed to be helpful in providing the reader with background information to facilitate a better understanding of the various aspects of the present invention. Accordingly, it should be understood that these statements are to be read in this light, and not as admissions prior art.

Integrated circuits are generally mass produced by fabricating thousands of identical circuit patterns on a single semiconductor wafer and subsequently dividing them into identical die or chips. Semiconductor wafers are generally made of silicon. To produce an integrated circuit many commonly known processes are used to modify, remove, and deposit material onto the semiconductor wafer. Processes such as ion implantation, sputtering, etching, chemical vapor deposition and variations thereof, such as plasma enhanced chemical vapor deposition, are among those commonly used. These processes are often selectively applied to an integrated circuit through the use of a masking process. In the masking process, a photomask containing the pattern of the structure to be fabricated is created, and the wafer is coated with a light sensitive material called photoresist. Then the resist-coated wafer is exposed to ultraviolet light through a photomask to soften or harden parts of the resist depending on whether positive or negative resist is used. Once the softened parts of the resist are removed, the wafer is treated by one of the processes discussed above to modify, remove, or replace the part unprotected by the resist, and then the remaining resist is stripped.

These steps of deposition or removal are frequently followed by a planarization step such as chemical mechanical planarization (CMP). Generally speaking, planarization is a process of removing material to render a surface smooth. CMP is the process of smoothing and planing aided by chemical action and mechanical forces. The planarization process helps to minimize barriers to multilayer formation and metallization, as well as to smooth, flatten, and clean the surface. This process involves chemically etching a surface while also mechanically polishing it. The combined action of surface chemical reaction and mechanical polishing allows for controlled, layer-by-layer removal of the desired material from the wafer surface resulting in the preferential removal of protruding surface topography and producing a planarized wafer surface.

In the past few years, CMP has become one of the most effective techniques for planarizing a semiconductor wafer. In general, the CMP process involves holding a semiconductor substrate, such as a wafer, against a rotating wetted polishing pad under controlled downward pressure. Alternately, the CMP process may involve holding a wetted polishing pad while rotating a semiconductor substrate, such as a wafer, under controlled downward pressure. In this instance, a rotating wafer carrier is typically utilized to hold the wafer under controlled pressure against a polishing pad. A polishing slurry deposited onto the polishing pad may contain etchants and an abrasive material such as alumina or silica. The polishing pad is typically made up of a soft material such as felt fabric impregnated with blown polyurethane.

Thus, generally speaking, the CMP process consists of moving a sample surface to be polished against a pad that is used to provide support against the sample surface, and to carry slurry between a sample surface and pad to effect the polishing leading to planarization. Abrasive particles in the slurry cause mechanical damage on the sample surface, loosening the material for enhanced chemical attack or fracturing of the pieces of surface into a slurry where they dissolve or are swept away. The process is tailored to provide enhanced material removal rate with high points on surfaces, thus affecting the planarization. Chemistry alone typically will not achieve planarization because most chemical actions are isotopic. Mechanical grinding alone, theoretically, may achieve the desired planarization but is generally not desirable because of the potential extensive associated damage of the material surfaces.

The three key elements in the CMP process are the surface to be polished, the pad which enables the transfer of mechanical forces to the surface being polished, and the slurry which provides both chemical and mechanical effects. The term pad is used loosely to refer to any soft material which assists in material removal. One such pad is a polishing web. A polishing web generally includes a continuous roll of material which is fed through a series of rollers on a CMP system. The web is fed across a table with a solid support surface where a rotating wafer carrier applies the downward mechanical force against the web to facilitate the polishing of the wafer. As a wafer is planarized, material is removed from the wafer and deposited onto the web. After one or more planarization cycles, the web must be advanced to provide a fresh pad surface for planarization.

As the web is advanced, the supply roll of web material is emptied. Once the supply roller is empty, a new roll must be fed through the CMP system. Thus, the remaining web material that has not been used for processing is simply discarded. Likewise, as a new roll is fed through the CMP system, some amount of the web material cannot be used for CMP processing, since it must be fed through the CMP system and coupled to the take-up roller. Often ten or more feet of web material will remain unused.

The present invention may address one or more of the problems set forth above.

SUMMARY OF THE INVENTION

Certain aspects commensurate in scope with the disclosed embodiments are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In accordance with one aspect of the present invention, there is provided a system for thermally attaching web-based polishing pads in a chemical-mechanical planarization (CMP) system. Specifically, one end of a first web-based polishing pad and one end of a second web-based polishing pad are inserted into a thermal sealing unit. The ends of the polishing pad are brought in contact with each other and secured in place within the thermal sealing unit. A heating element within the thermal sealing unit is activated, thereby fusing the polishing pads.

In accordance with another aspect of the present invention, there is provided a thermal sealing unit which includes a heating element and a coupling mechanism. The coupling mechanism will bring one end of a first web-based polishing pad into contact with one end of a second web-based polishing pad. The heating element is activated, thereby fusing the polishing pads.

In accordance with yet another aspect of the present invention, there is provided a system of attaching one end of a first polishing web to one end of a second polishing web. One end of the first polishing web and one end of the second polishing web are inserted into a web attachment unit. The polishing webs are fused together by the web attachment unit.

BRIEF DESCRIPTION OF THE DRAWINGS

The foregoing and other advantages of the invention may become apparent upon reading the following detailed description and upon reference to the drawings representing exemplary embodiments in which.

DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

One solution to the problems set forth above is to attach the trailing end of a web roll which has reached its end to the leading end of a new roll. By attaching the rolls, the need for a certain amount of feeder web on the new roll may be eliminated. Further, the trailing end of the old roll can be used in its entirety.

To attach the new roll to the old roll, an adhesive tape may be used. However, due to the weight of the rolls and the pulling force associated with feeding the web through the CMP machine, a tape may not hold the rolls securely together. Likewise, glue or mechanical fasteners, such as staples, may be used to attach the rolls. However, these solutions again may present problems in holding the rolls together during the CMP processing. Therefore, in the exemplary embodiment described below, an exemplary apparatus and method for thermally coupling the rolls together is presented.

Figure 1:
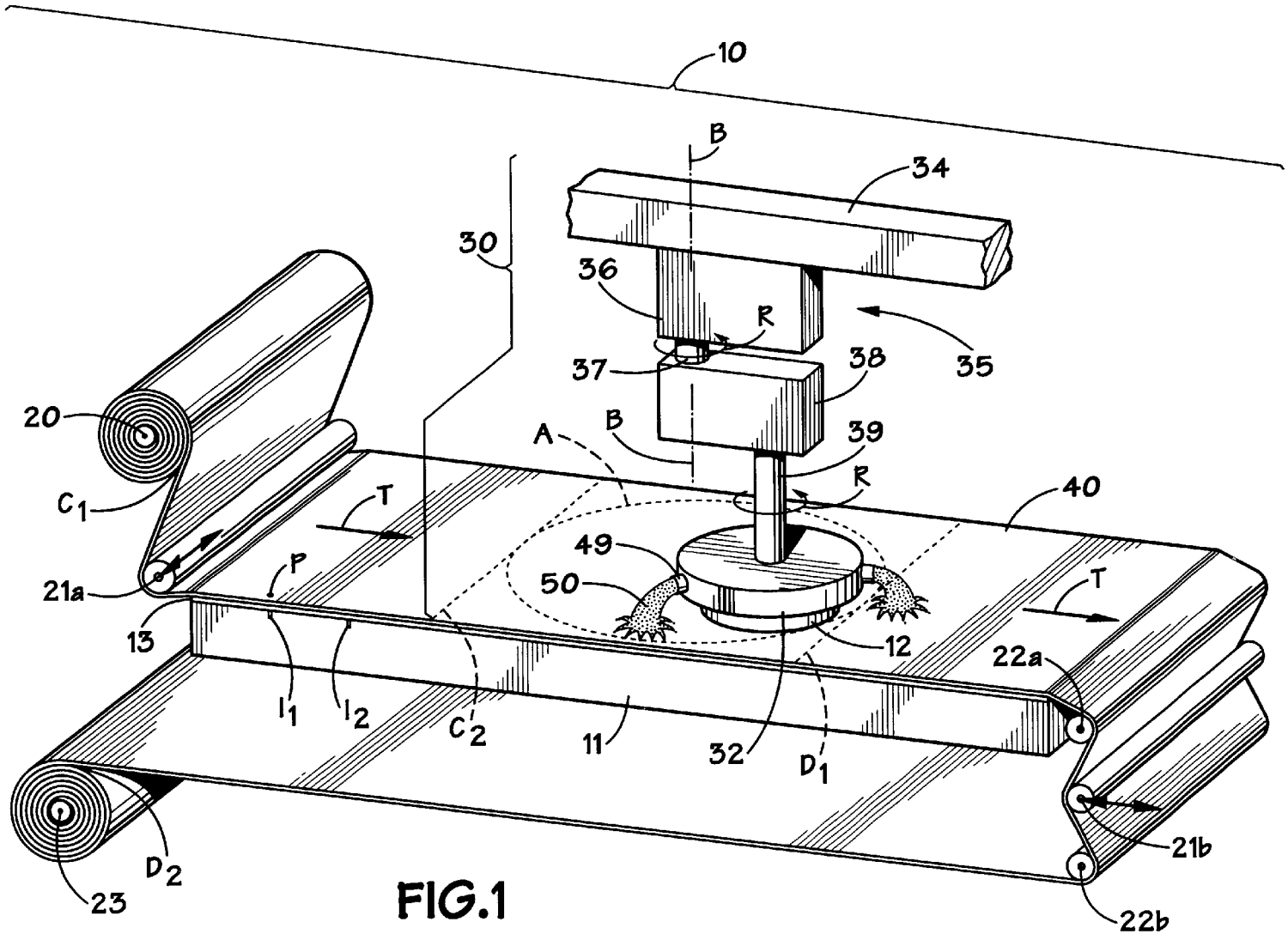
FIG.1 (PRIOR ART)
FIG. 1 illustrates a perspective view of an exemplary web-based chemical mechanical planarization (CMP) system.

FIG. 1 is a schematic isometric view of an exemplary web-format planarizing machine 10 for planarizing a substrate 12. The planarizing machine 10 has a table 11 with a rigid panel or plate to provide a flat, solid support surface 13 for supporting a portion of a web-format planarizing pad 40 in a planarizing zone "A." The planarizing machine 10 also has a pad advancing mechanism including a plurality of rollers to guide, position, and hold the web-format polishing pad 40 over the support surface 13. The pad advancing mechanism generally includes a supply roller 20, tensioning rollers 21*a* and 21*b*, idler rollers 22*a* and 22*b*, and a take-up roller 23.

As explained below, a motor (not shown) drives the take-up roller 23 to advance the pad 40 across the support surface 13 along a travel axis T—T. The motor (or another motor) may also be used to drive the supply roller 20. The idler rollers 22*a* and 22*b* press an operative portion of the pad against the support surface 13 to hold the pad 40 stationary during operation.

The planarizing machine 10 also includes a carrier assembly 30 to translate the substrate 12 across the pad 40. In one embodiment, the carrier assembly 30 has a head 32 to pick up, hold, and release the substrate 12 at appropriate stages of the planarizing process. The carrier assembly 30 also has a support gantry 34 and a drive assembly 35 that can move along the gantry 34. The drive assembly 35 has an actuator 36, a drive shaft 37 coupled to the actuator 36, and an arm 38 projecting from the drive shaft 37. The arm 38 carries the head 32 via another shaft 39. The actuator 36 orbits the head 32 about an axis B—B and the shaft 39 rotates in the direction R to move the substrate 12 across the pad 40 generally within the area A.

The polishing pad 40 may be a non-abrasive polymeric pad (e.g., polyurethane), or it may be a fixed-abrasive polishing pad in which abrasive particles are fixedly dispersed in a resin or another type of suspension medium. A planarizing fluid 50 is deposited onto the pad 40 as part of the planarizing operation. While various techniques may be used for depositing this fluid, in this embodiment the planarizing fluid 50 flows from a plurality of nozzles 49 during planarization of the substrate 12. The planarizing fluid 50 may be a conventional CMP slurry with abrasive particles and chemicals that etch and/or oxidize the surface of the substrate 12, or the planarizing fluid 50 may be a non-abrasive planarizing solution without abrasive particles, such as cleaning fluid. In most CMP applications, abrasive slurries with abrasive particles are used on non-abrasive polishing pads, and non-abrasive solutions without abrasive particles are used on fixed-abrasive polishing pads.

During the operation of the planarizing machine 10, the pad 40 moves across the support surface 13 along the pad travel path T—T either during or between planarizing cycles to change the particular portion of the polishing pad 40 in the planarizing zone A. For example, the supply and take-up rollers 20 and 23 can drive the polishing pad 40 between planarizing cycles such that a point P moves incrementally across the support surface 13 to a number of intermediate locations $I_1$, $I_2$, etc. Alternatively, the rollers 20 and 23 may drive the polishing pad 40 between planarizing cycles such that the point P moves all the way across the support surface 13 to completely remove a used portion of the pad 40 from the planarizing zone A. The rollers may also continuously drive the polishing pad 40 at a slow rate during a planarizing cycle such that the point P moves continuously across the support surface 13. Thus, the polishing pad 40 should be free to move axially over the length of the support surface 13 along the pad travel path T—T.

As the polishing pad 40 is advanced, the amount of pad material contained on the supply roll 20 is depleted, while the amount of pad material contained on the take-up roll 23 is increased. Once the supply roll 20 is empty, the polishing pad 40 is removed and replaced with another pad. Thus, there is a segment of unused polishing pad 40 which remains unused. The unused portion of the polishing web between locations $C_1$ and $C_2$ remains unused when the pad 40 is discarded. Once a new polishing pad (not shown) is loaded onto the supply roller 20, a segment of the new polishing pad must be fed across the support surface 13, through tensioning rollers 21*a* and 21*b*, through idler rollers 22*a* and 22*b* and onto the take up roller 23. Thus, there will also be an unused portion of the new polishing web between locations $D_1$ and $D_2$. This portion of the new polishing web is essentially wasted material.

Figure 2:
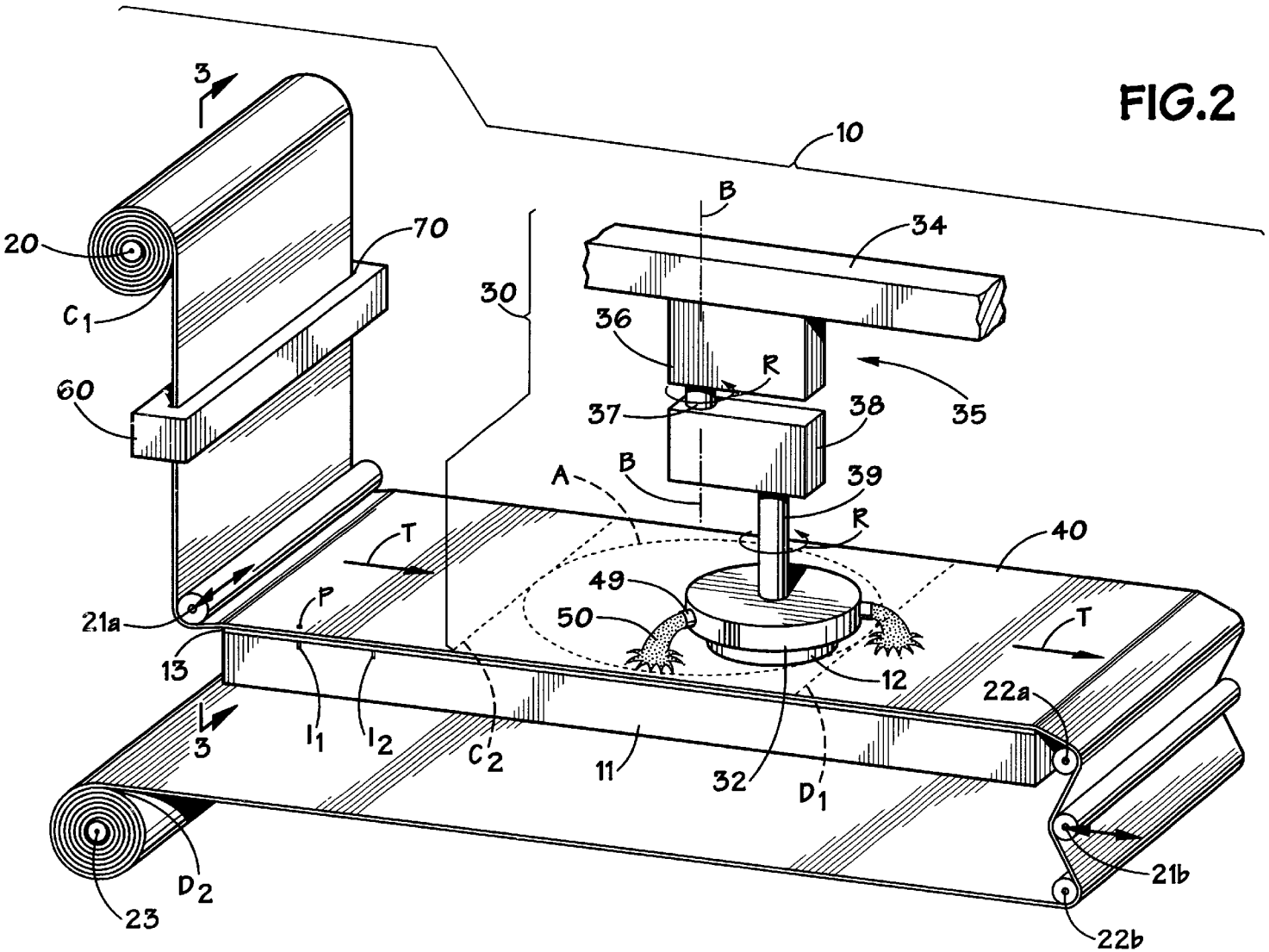
FIG. 2 illustrates a perspective view of a web-based system in accordance with the present invention.

FIG. 2 illustrates a perspective view of the web-based CMP system illustrated in FIG. 1, in accordance with the present invention. For clarity, elements similar to those discussed with reference to FIG. 1 are numbered similarly. In one embodiment, a web attachment unit, here a thermal sealing unit 60 is positioned proximate to the present CMP system. The thermal sealing unit 60 maybe positioned between supply roller 20 and tensioning roller 21*a*. The polishing pad 40 is fed through a slot 70 in the thermal sealing unit 60. In this embodiment of the thermal sealing unit 60, the unit is comprised of a single block, and the slot 70 is formed as an opening through the thermal sealing unit 60. Alternately, the thermal sealing unit 60 may be comprised of a front block and a rear block which may be attached in such a way as to form slot 70.

Figure 3:
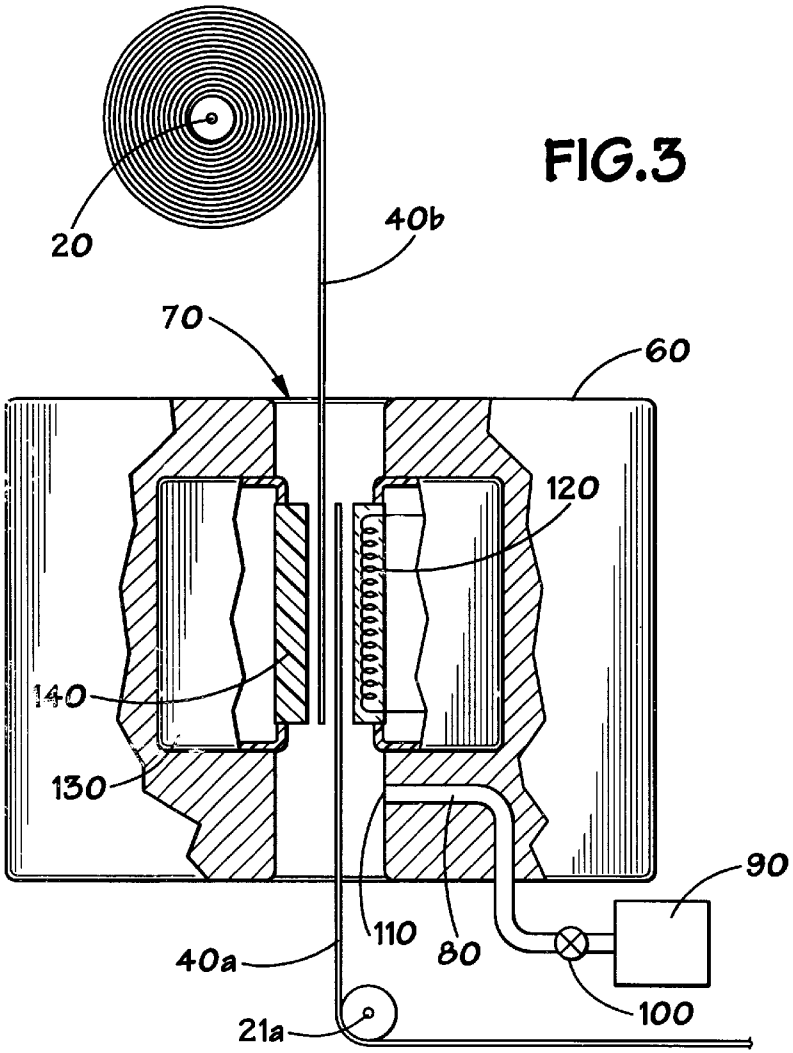
FIG. 3 illustrates a cross-section of the web-based CMP system illustrated in FIG. 2, taken along line 3—3.

FIG. 3 illustrates a cross-section of the web-based CMP system illustrated in FIG. 2, taken along line 3—3. The CMP system is illustrated at the time at which a first polishing web 40*a* has been completely depleted from the supply roller 20. As illustrated in FIG. 3, the first polishing web 40*a* has been manually advanced so that the end of polishing pad 40*a* is contained within the thermal sealing unit 60. A new polishing pad 40*b* has been mounted on supply roller 20, and manually advanced in such a way as to position the first portion of the polishing web 40*b* within the thermal sealing unit 60.

It should be noted that while the supply roller 20 may be manually advanced within the thermal sealing unit 60, the supply roller 20 may also be advanced by an automated system. The automated system may include a mechanical means of sensing the end of the first polishing web 40*a* and advancing the first portion of the new polishing web 40*b* within the thermal sealing unit 60. The entire thermal sealing process, including loading a polishing web 40*a* onto the supply roller 20, sensing the end of the polishing web 40*a*, loading a new polishing web 40*b* onto the supply roller 20 and sealing the ends of the polishing webs 40*a* and 40*b*, may be automated such that operator intervention is typically unnecessary.

Referring still to FIG. 3, if it is desired to secure the first polishing pad 40*a* within the unit 60 during the thermal sealing process, a vacuum 80 may be used. The vacuum 80 may be driven by an external vacuum source 90, and the vacuum flow may be controlled by an activation valve 100. The end of the polishing pad 40*a* will be drawn to the vacuum hold area 110 to be held in place within the thermal sealing unit 60. Of course, if this function is to be performed, any other suitable apparatus, such as a clamp or tape, may be used.

The thermal sealing unit 60 is further comprised of a sealing apparatus that may include a heating element 120 and coupling mechanism, such as a pressure inflation bladder 130, for example. As the beginning of the new polishing pad 40*b* is advanced into the thermal sealing unit 60 through slot 70, it is positioned within the thermal sealing unit 60 between the thermal heating element 120 and the pressure inflation bladder 130. During the thermal sealing process, pressure inflation bladder 130 is expanded. As the pressure inflation bladder 130 expands, the insulating layer 140 is brought in contact with the new polishing pad 40*b*. As the pressure inflation bladder 130 continues to expand, the new polishing pad 40*b* is brought in contact with the first polishing pad 40*a* and the first polishing pad 40*a* is pressed in contact with thermal heating element 120. Thus, the beginning of polishing pad 40*b* and the end of polishing pad 40*a* are sandwiched between insulating layer 140 and the thermal heating element 120. It should be understood that any other suitable coupling mechanism capable of bringing the pads 40*a* and 40*b* into contact with the heating element 120 may be used in place of the bladder 130. Alternately, the thermal heating element 120 may be configured to heat the polishing pads 40*a* and 40*b* sufficiently to thermally couple the pads 40*a* and 40*b* without being brought in contact with either pad 40*a* or 40*b*.

Once the thermal heating element 120 is activated, the polishing pads 40*a* and 40*b* will be thermally fused together. The thermal heating element 120 may operate at a temperature range from 50° C. to 350° C. and for a duration of 15 sec. to 300 sec. Once the sealing process has been completed, polishing pads 40*a* and 40*b* will be coupled together. During the CMP process, supply roller 20 may be rotated and the polishing pad 40*b* may be advanced through the system.

In this way, only the portion of polishing pad 40*b* which has been thermally sealed to polishing pad 40*a* may not be used in the planarization process. Advantageously, only a four to eight inch portion of each polishing pad 40*a* and 40*b* is unused during the planarization process.

Figure 4:
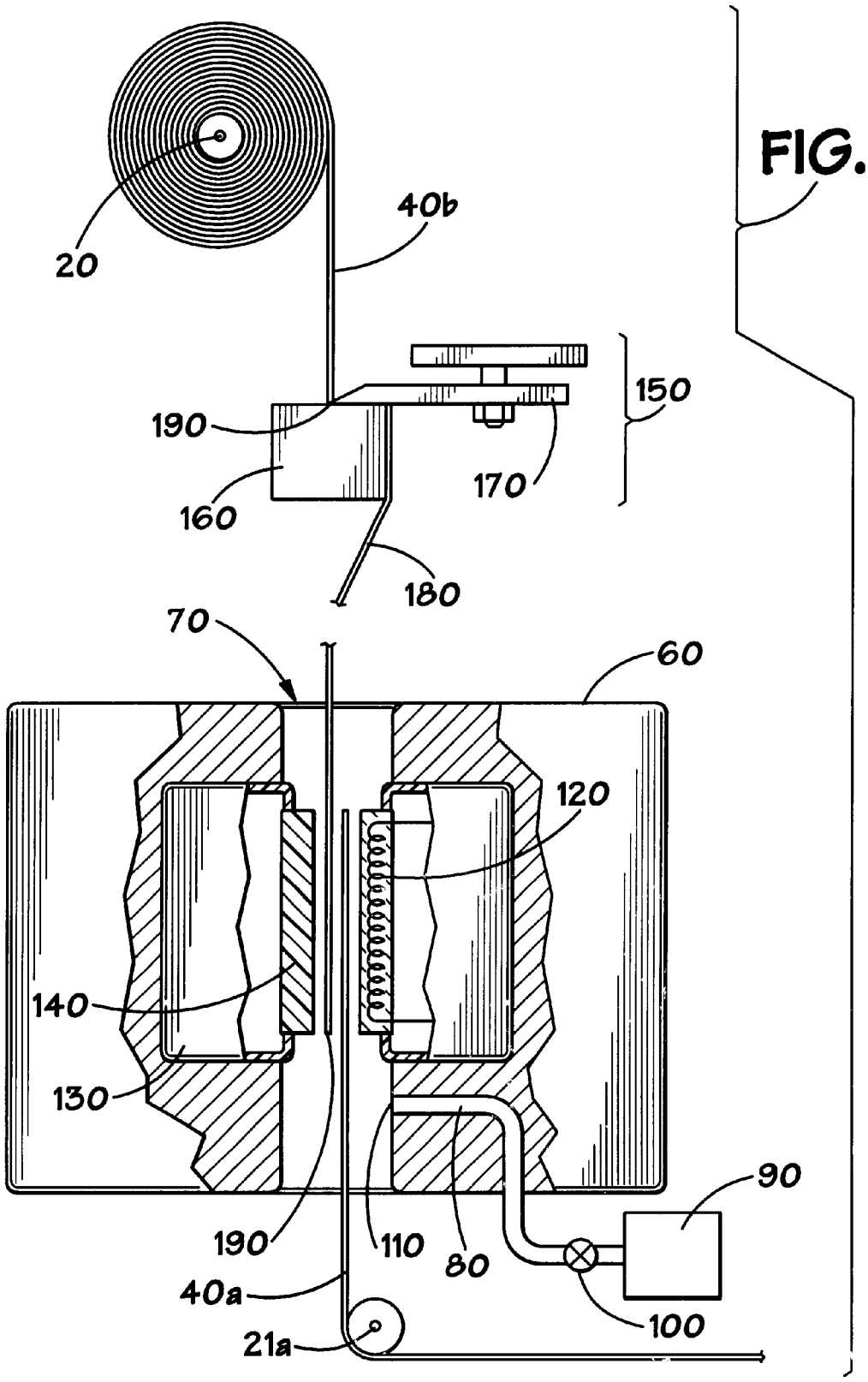
FIG. 4 illustrates an alternate embodiment of a web-based CMP system in accordance with the present invention.

FIG. 4 illustrates an alternate embodiment of the present invention. Web-based polishing pads may be manufactured with uneven ends. To ensure that there are clean edges on the ends of the polishing pads 40*a* and 40*b*, it may be desirable to cut the ends in such a way as to create a uniform edge for the thermal sealing process. Therefore, a CMP system in accordance with the present invention may also include a roll cutter unit 150. The roll cutter unit 150 may be comprised of a cutting bar 160 and a blade 170. The roll cutter unit 150 may be used to provide a clean edge on polishing pads 40*a* and 40*b* to optimize the thermal sealing. The blade 170 is used to remove the non-uniform portion 180 of the polishing pad 40*b* to create a uniform end 190 of the polishing pad 40*b*. After the cutting operation, the uniform end 190 may then be advanced within the thermal sealing unit 60 to thermally attach polishing pad 40*a* to 40*b*, as described above with reference to FIG. 3.

Figure 5:
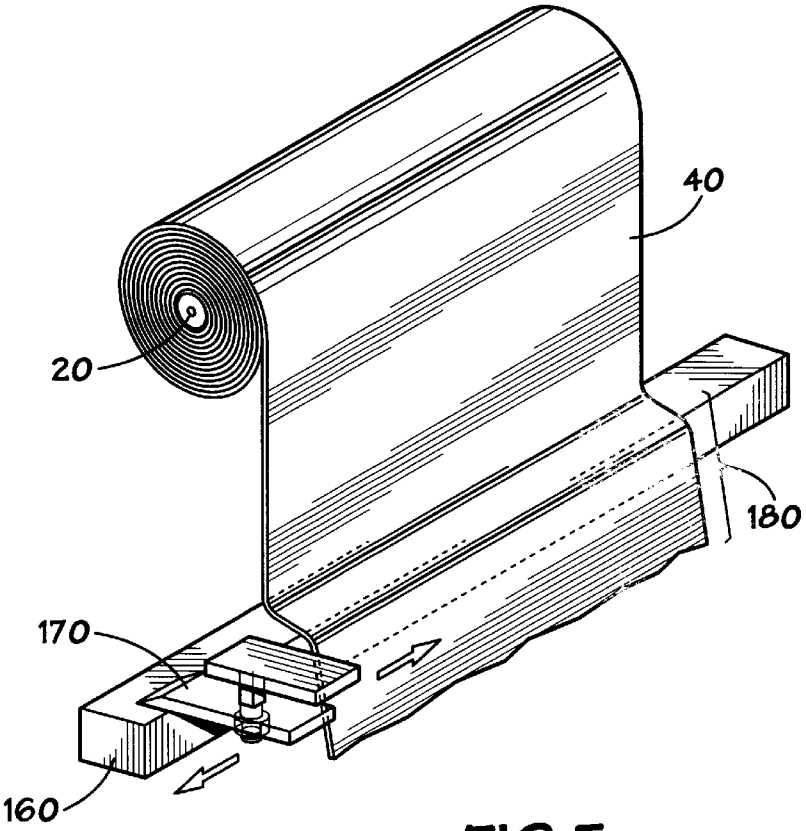
FIG. 5 illustrates a perspective view of the embodiment illustrated in FIG. 4.

FIG. 5 illustrates a perspective view of the embodiment of the roll cutter unit 150 illustrated in FIG. 4. The blade 170 traverses the cutting bar 160 in a direction which is parallel to the cutting bar 160. The blade 170 is positioned proximate to the cutting bar 160. A polishing web 40 may be advanced several inches over the cutting bar 160. In particular, the polishing pad 40 is advanced beyond any non-uniform portion 180 of polishing pad 40. As the blade 170 traverses the length of the cutting bar 160, the non-uniform portion 180 of the polishing pad 40 is removed and discarded. This process will create a uniform end 190 (shown in FIG. 4) to be used during the thermal sealing process.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. In a system for planarizing a substrate by polishing, the improvement comprising:

a thermal sealing unit comprising:

a thermal heating element; and a coupling mechanism to move a portion of a first polishing web into contact with a portion of a second polishing web to define an overlapping portion, and to move the overlapping portion into contact with the thermal heating element.

2. The system, as set forth in claim 1, wherein the coupling mechanism comprises a pressure inflation bladder.

3. The system, as set forth in claim 2, wherein the pressure inflation bladder is coupled to a coupling mechanism to move an insulating layer into contact with a portion of a first polishing web and in further contact with a portion of a second polishing web to define an overlapping portion and to move the overlapping portion into contact with a thermal heating element.

4. A method of attaching an end of a first polishing web to an end of a second polishing web, comprising the acts of:

(a) inserting the end of the first polishing web into a thermal sealing unit;

(b) inserting the end of a second polishing web into the thermal sealing unit; and (c) activating a heating element contained within the thermal sealing unit for a period of time.

5. The method, as set forth in claim 4, comprising the act of moving the end of the second polishing web into contact with the end of the first polishing web.

6. The method, as set forth in claim 4, comprising the act of securing the end of the first polishing web in the thermal sealing unit with a vacuum.

7. The method, as set forth in claim 4, wherein act (a) comprises the act of manually inserting the end of the first polishing web into the thermal sealing unit.

8. The method, as set forth in claim 4, wherein act (b) comprises the act of manually inserting the end of the second polishing web into the thermal sealing unit.

9. The method, as set forth in claim 5, wherein the act of moving the end of the second polishing web into contact with the end of the first polishing web comprises the act of inflating a pressure inflation bladder.

10. The method, as set forth in claim 4, wherein act (c) comprises the act of activating the element for 15 to 300 seconds.

11. The method, as set forth in claim 4, comprising the act of cutting the end of the first polishing web to provide a uniform edge for the thermal sealing process.

12. The method, as set forth in claim 11, comprising the act of cutting the end of the first polishing web with a roll cutter unit comprising a blade.

13. The method, as set forth in claim 4, comprising the act of cutting the end of the second polishing web to provide a uniform edge for the thermal sealing process.

14. The method, as set forth in claim 13, comprising the act of cutting the end of the second polishing web with a roll cutter unit comprising a blade.

15. A method of attaching an end of a first polishing web to an end of a second polishing web, comprising the acts of:

(a) positioning the end of a first polishing web proximate to the end of a second polishing web within a thermal sealing unit; and (b) activating a heating element contained within the thermal sealing unit for a period of time.

16. The method, as set forth in claim 15, wherein act (a) comprises the acts of:

(a) inserting the end of the first polishing web into a thermal sealing unit; and (b) inserting the end of a second polishing web into the thermal sealing unit.

17. The method, as set forth in claim 16, comprising the act of moving the end of the second polishing web into contact with the end of the first polishing web.

18. The method, as set forth in claim 16, comprising the act of securing the end of the first polishing web in the thermal sealing unit with a vacuum.

19. The method, as set forth in claim 16, wherein act (a) comprises the act of manually inserting the end of the first polishing web into the thermal sealing unit.

20. The method, as set forth in claim 16, wherein act (b) comprises the act of manually inserting the end of the second polishing web into the thermal sealing unit.

21. The method, as set forth in claim 16, wherein the act of moving the end of the second polishing web into contact with the end of the first polishing web comprises the act of inflating a pressure inflation bladder.

22. The method, as set forth in claim 15, wherein act (b) comprises the act of activating the heating element for 15 to 300 seconds.

23. The method, as set forth in claim 16, comprising the act of cutting the end of the first polishing web to provide a uniform edge for the thermal sealing process.

24. The method, as set forth in claim 23, comprising the act of cutting the end of the first polishing web with a roll cutter unit comprising a blade.

25. The method, as set forth in claim 16, comprising the act of cutting the end of the second polishing web to provide a uniform edge for the thermal sealing process.

26. The method, as set forth in claim 25, comprising the act of cutting the end of the second polishing web with a roll cutter unit comprising a blade.

* * * * *